United States Patent [19]

Bauer et al.

[11] Patent Number: 4,834,197

[45] Date of Patent: May 30, 1989

[54] TRENCH CUTTER

[75] Inventors: Karlheinz Bauer; Johann Haberer, both of Schrobenhausen; Maximilian Arzberger, Igenhausen, all of Fed. Rep. of Germany

[73] Assignee: Bauer Spezialtiefbau GmbH, Schrobenhausen, Fed. Rep. of Germany

[21] Appl. No.: 193,742

[22] Filed: May 13, 1988

[30] Foreign Application Priority Data

May 13, 1987 [DE] Fed. Rep. of Germany ..... 3715977

[51] Int. Cl.[4] ..... E02F 5/08

[52] U.S. Cl. ..... 175/91; 299/85; 37/80 A

[58] Field of Search ..... 299/80, 85, 89; 37/80 A, 91, 94; 175/91, 96, 273

[56] References Cited

U.S. PATENT DOCUMENTS

| | | | |
|---|---|---|---|
| 3,279,856 | 10/1966 | Silks | 175/91 X |
| 3,439,758 | 4/1969 | Petersen | 299/85 |
| 3,857,610 | 12/1974 | Snyder | 299/86 |
| 4,172,616 | 10/1979 | Delli-Gotti | 299/89 X |
| 4,718,731 | 1/1988 | Bauer et al. | 299/85 |

FOREIGN PATENT DOCUMENTS

| | | | |
|---|---|---|---|
| 253726 | 1/1988 | European Pat. Off. | 37/91 |
| 2719160 | 11/1977 | Fed. Rep. of Germany . | |
| 467181 | 7/1975 | U.S.S.R. | 299/89 |

OTHER PUBLICATIONS

*Bored Pile Foundations,* A Brochure Produced by Bauer Spezialtiefbau GmbH, Schrobenhausen, West Germany, n.d., 10/1987.

*Primary Examiner*—Jerome W. Massie, IV
*Assistant Examiner*—David J. Bagnell
*Attorney, Agent, or Firm*—Fleit, Jacobson, Cohn & Price

[57] ABSTRACT

A trench cutter has cutting wheels with radially projecting cutting teeth and is arranged on a bearing bracket. Along the bearing bracket, hinged teeth are arranged on one edge of the cutting wheel hub. The hinged teeth have two arms, one arm serving as a control arm, which engages with a control ledge arranged on the bearing bracket, and the other arm serving as cutting tooth. The control ledge and the control arm form a wedge gear which forces the hinged teeth into a swing-out position in front of the free end of the bearing bracket.

13 Claims, 3 Drawing Sheets

28
25
26
27
1
2,3
23,24

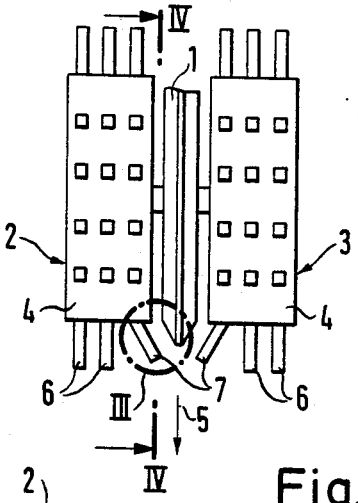
Fig. 2
Fig. 3
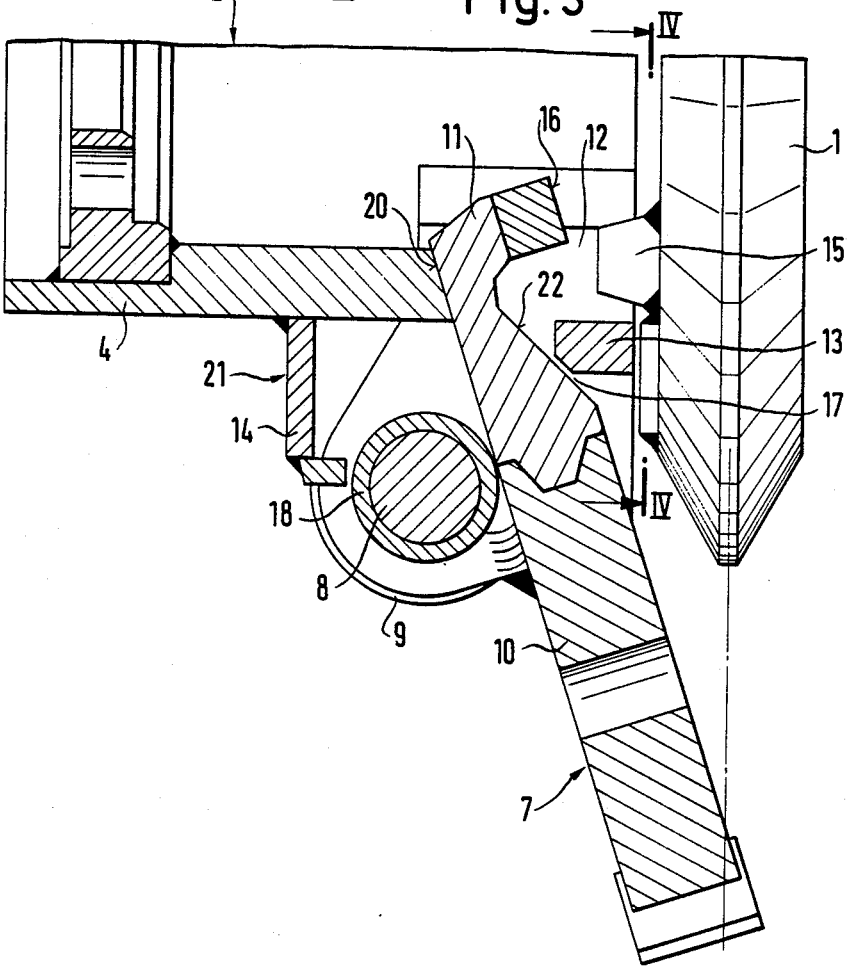

TRENCH CUTTER

BACKGROUND OF THE INVENTION

The invention relates to a trench cutter with a cutting wheel, with a bearing bracket extending into the vicinity of the outer circumference of the cutting wheel hub and with hinged teeth, which are pivotably articulated in a circumferentially distributed manner to the edge of the cutting wheel hub facing the bearing bracket.

BACKGROUND INFORMATION

In such cutting devices as described in applicants' U.S. Pat. No. 4,718,731, the teeth project radially and frequently form a plurality of toothed rims spaced from the hub in the axial direction of the milling wheel. The removal and loosening of rock and soil take place through the cutting wheels being moved at right angles to their axis, the soil being cut in an area corresponding to the width of the cutting wheel and accompanied by the formation of a trench. Therefore, such machines can also be described as trench wall milling machines.

To ensure that the area located in front of or below the bearing bracket or plate is also worked, hinged teeth are arranged along the adjacent edge of the cutting wheel hub and in the swung out position enter the soil located upstream of the cutting plate. Due to the fact that the hinged teeth can only give way in a predetermined direction, during the advance of the cutting wheel, the teeth may be automatically pivoted into their working position as a result of soil pressure. Although such an arrangement operates reliably in most cases, with specific characteristics of the soil, the pivoting movement may not take place in the requisite, desired manner. Further cutting devices are disclosed in U.S. Pat. No. 2,752,142 and U.S.S.K. Pat. No. 467,181.

SUMMARY OF THE INVENTION

It is an object of the present invention to provide a cutting device of the aforementioned type, where any giving way of the hinged teeth is prevented.

According to the invention this problem is solved in that the hinged teeth are constructed in a two-armed manner with a rear control arm and an outwardly directed milling tooth and that in each case there is a wedge gear between the control arm of each hinged tooth and the bearing bracket, so that the hinged teeth are necessarily brought into the swung out position.

Thus, the invention makes use of the principle of achieving through a positive forced control an action and deflection of the hinged teeth independent of the back pressure of the soil. Therefore, the invention has the advantage that an optimum advance can be achieved, because the soil or rock is reliably removed upstream of the bearing bracket. The wedge gear permits a smooth guidance of the hinged teeth, the path of the hinged tooth deflection being fixable by the inclination of the wedge surfaces. In other words, this could be termed a cam control.

According to a preferred construction of the invention the wedge gear comprises a circumferentially directed first wedge surface on the control arm and a control ledge arranged along a circular sector coaxially to the cutting wheel on the bearing bracket, whereby the control ledge engages with the wedge surface if the associated hinged tooth moves past the control ledge during a rotary movement of the cutting wheel, the control ledge length determining the deflection duration.

It can also be advantageous to provide the control arm with a circumferentially entering and exiting wedge surface. Thus, both when swinging in and when swinging out, it is ensured that the bearings of the hinged teeth are not stressed by sudden movements.

It can also be advantageous to provide a cam-like configuration for the deflection of the hinged teeth.

According to an alternative construction of the wedge gear, the latter has a wedge surface passing radially over the control arm and a control ledge arranged on the bearing bracket for engaging with the wedge surface. The control ledge is arranged on a path with varying radius, so that in the case of a rotation of the hinged tooth or the cutting wheel, the control ledge is guided radially along the wedge surface.

For compensating the distance between the hinged teeth and the bearing bracket, it can be advantageous to arrange the control arm in angular manner with respect to the milling tooth.

According to another preferred further development of the invention the control arm is guided through an opening in the hub into the interior of the latter and, on the end face of the hub, engages with the control ledge. This measure makes it possible to give a relatively long construction to the control arm, so that the leverage of the milling tooth is increased, but the swivel bearing can still be arranged as close as possible to the hub.

It is particularly appropriate to provide the edge of the hub opening as a rear stop, for the control arm. This stop, which has to absorb the advance pressure acting on the milling tooth, can be constructed in the simplest possible way without any additional precautions. The arrangement is also particularly robust due to the stable construction of the hub. A protection against the penetrating soil is achieved in that the bearings of the hinged teeth and the area between the hub edge and the bearing bracket is protected by a cover.

This can take place particularly effectively in that the cover comprises ledges, which are arranged over the entire circumference of the hubs.

BRIEF DESCRIPTION OF THE DRAWINGS

The invention is described in greater detail hereinafter relative to an embodiment illustrated in the attached drawings, in which

FIG. 2 is a diagrammatic view of two milling wheels on a bearing bracket of the trench cutter of FIG. 1;

FIG. 3 is a sectional view of a hinged tooth of the milling wheel in an area III of FIG. 2.

DETAILED DESCRIPTION OF THE PREFERRED EMBODIMENT

Figure 1:
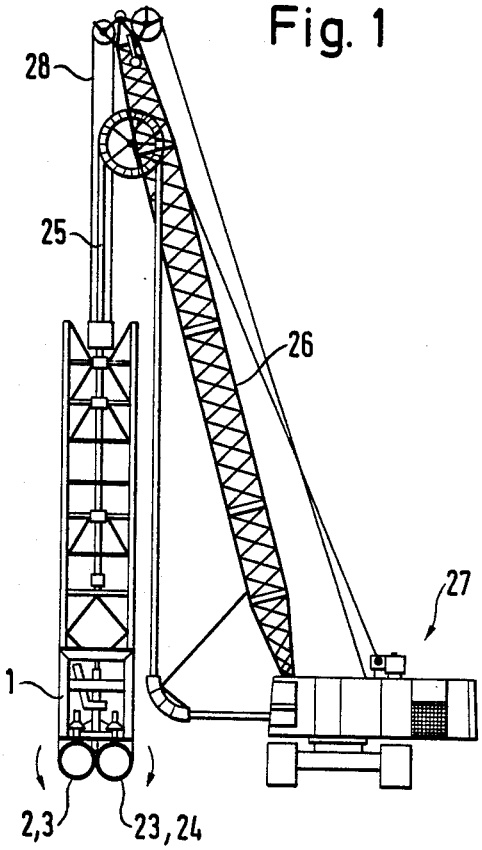
FIG. 1 is a diagrammatic view of a trench cutter according to the instant invention.

FIG. 1 shows diagrammatically a view of a trench cutter with two contra-rotating equal pairs of cutting wheels 2, 23 and 3, 24, respectively, on a bearing bracket 1 as further illustrated in FIG. 2. The bearing bracket 1 suspends from an arm assembly 26 of a conventional crane 27. The bearing bracket 1 can be moved in horizontal direction by inclining the arm assembly 26 and in a vertical direction by means of a cable pull 28.

The trench cutter is driven by a conventional hydraulic system which is part of the crane 27.

To produce a trench the wheels 2, 3, 23, 24 cut or break the earth or rock and transport it to the middle, where it is suctioned off in conventional manner with supporting slurry provided by pipelines 25. The slurry and the earth are separated in a conventional desanding system (not shown). The slurry is than pumped back and is once more available in the trench.

FIG. 2 illustrates one of the pairs of cutting wheels 2, 3 pivoted on the bearing bracket 1. The drawing shows the cutting wheels 2, 3 in a view at right angles to the rotation axis of the cutting wheels 2, 3. During operation the wheels 2, 3 are moved traverse to their axis in the direction of arrow 5, whilst rotating the cutting wheels 2, 3. A plurality of cutting teeth 6, which projects radially from the hub 4, of the cutting wheels 2, 3, and which are distributed over the entire hub surface in circumferential lines enter the soil and form the not shown trench.

On the axially inner edges of the two hubs 4 adjacent to the bearing bracket 1 the cutting teeth 6 are constructed as hinged teeth 7, which are controlled by a forced control means shown in FIG. 3 in such a way that they assume their swung out position upstream of and below the bearing bracket. The hinged teeth 7 act on the soil located between the two cutting wheels 2, 3 and prevent soil from being left in front of the bearing bracket.

In cross-section, FIG. 3 illustrates in detail the control of the hinged teeth 7. The hinged tooth 7 is arranged with a pivot pin 8 in a bearing eye 9 arranged on hub 4. The pivot pin is located laterally alongside the longitudinal axis of hinged tooth 7. Hinged tooth 7 is constructed with two arms, one arm being formed by an outwardly freely projecting milling tooth 10 and the other arm, referred to hereinafter as the control arm 11, is formed by an extension of milling tooth 10 extending rearwards over the pivot pin 8. Control arm 11 is inserted through an opening 12 into the interior of hub 4. An edge 20 of opening 12 serves as a rear stop used for determining the maximum slope of the hinged tooth 7 and as illustrated in FIG. 2. The support for the hinged tooth 7 and opening 12 are protected with respect to the outside against penetrating soil by means of a casing 21, which comprises a first ledge 13 arranged on the hub and located between the hub edge and the control arm 11, particularly for covering opening 12, and a second ledge 14 with a L-shaped cross-section, which passes substantially radially between hub 4 and pivot pin 8 to prevent soil from penetrating the bearing eye 9.

From the end face of the cutting wheel 2, control arm 11 is subject to the action of a control ledge 15 arranged on the bearing bracket 1 and which passes along a circular sector. Control ledge 15 has a bevelled entry and exit, which provides the control ledge with a wavy configuration and which cannot be seen in the drawing as a result of the selected representation mode. Control ledge 15, together with a mating surface 16 on control arm 11, forms a wedge gear which leads to a swinging out of the hinged tooth 7 as soon as the mating surface 16 comes into contact with control ledge 15 during a rotation of hub 4. For as long as mating surface 16 slides along the control ledge, said deflection is retained. As a result of a cam-like configuration of control ledge 15 it is also possible to achieve a pre-determined swinging movement of hinged tooth 7. FIG. 3 illustrates a position of the hinged tooth 7 with its maximum inclination, into which the hinged tooth 7 is forced by an external pressure on the milling tooth 10, e.g. by soil pressure. It becomes clear from the gap between control ledge 15 and mating surface 16 that in the respective embodiment, control ledge 15 merely serves to initiate and maintain a minimum inclination and that further inclination due to external pressure is also possible depending on the location of edge 20.

The control arm 11 is further provided with an area 22 opposite the free end of the first ledge 13. The area 22 is shaped in radial direction in a way so that at any position of the hinged tooth, 7 the distance 17, which is the minimal distance possible between the area 22 and the free end of the first ledge 13 without impeding each other, is kept constant to secure the sealing of the opening 12. This is achieved by an eccentric arrangement of hinged tooth 7 on the pivot pin 8 by means of a bearing sleeve 18. If, for purposes of illustration, the hinged tooth 7 rotates clockwise from the shown position, the hinged tooth 7 also accomplishes a tangential movement due to its eccentric arrangement so that the area 22 is moved beneath the free end of the first ledge 13.

Figure 4:
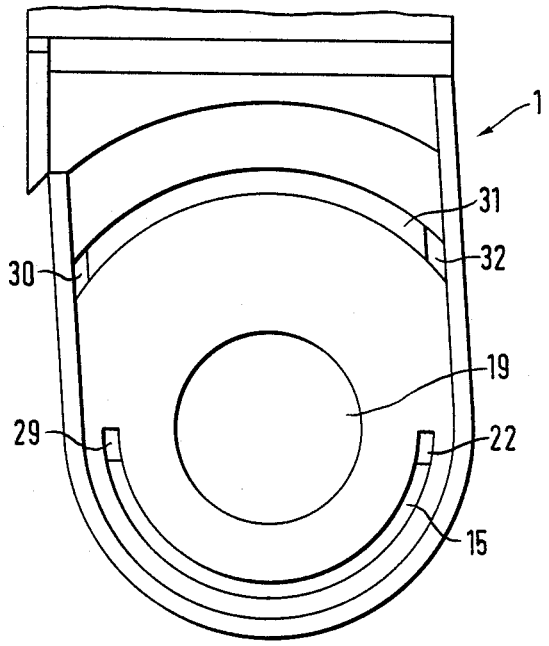
FIG. 4 is a diagrammatic partial side view of the bearing bracket of the trench cutter according to arrow IV of FIGS. 2 and 3.

FIG. 4 shows that the control ledge 15 occupies a semicircle on the lower end of the bearing bracket 1. The semicircle is coaxial to the axis (not shown) of the cutting wheel (not shown) which is mounted perpendicular to the drawing plane in circular opening 19 in the bearing bracket 1. Assuming clockwise rotation of the respective cutting wheel the mating surfaces 16 of the hinged teeth 7 in their horizontal position get into contact with the bevelled entry 22 of the control ledge 15 to achieve a gradual transition between their straight position and the inclined position. While passing the semicircle of the control ledge 15 the hinged teeth 7 are forced in said position.

The swung-out position will be left after passing a bevelled exit 29 of the control ledge 15.

The hinged teeth 7 are brought into their straight, swung-in position when the free ends of their cutting teeth 6 engage with a sliding surface 31, which has a further bevelled entry 30 and a further bevelled exit 32. The sliding surface 31 is arranged coaxially to the axis of the cutting wheel. Since it co-acts with the free ends of the cutting teeth 6 its radius is greater than the radius of the control ledge 15. The sliding surface 31 is arranged on the surface of the bearing bracket 1 from its rear end to its front end along the circular path of the ends of the milling teeth 6.

In place of the entry 22 and exit 29 of control ledge 15, it can also be appropriate to provide the mating surface 16 of the hinged tooth 7 with a surface entering or exiting circumferentially of hub 4, in order to achieve a gradual transition between the two end positions of hinged tooth 7.

What we claim is:

1. A trench cutter, comprising a cutting wheel;

a cutting wheel hub having an outer circumference;

a bearing bracket having a rear end and a free end and extending in the area of the outer circumference of the cutting wheel hub;

hinged teeth pivotably articulated to the edge of the cutting wheel hub facing the bearing backet for deflection;

a wedge gear between the hinged teeth and the bearing bracket, the wedge gear being activated by rotary movement of the cutting wheel with the hinged teeth moving relative to the bearing bracket; and the wedge gear forcibly bringing the respective hinged teeth from a swung-in position, in which the hinged teeth can pass the rear end of the bearing bracket, to a swung-out position, in which the hinged teeth are pivoted in axial direction of the cutting wheel in front of the free end of the bearing bracket.

2. A trench cutter according to claim 1, wherein the wedge gear comprises a control ledge having a wedge surface on the bearing bracket and a control arm on each hinged tooth.

3. A trench cutter according to claim 2, wherein the wedge surface on the bearing bracket is arranged in a circular sector coaxial to the cutting wheel, the length of the wedge surface determining the duration of deflection of said hinged teeth.

4. A trench cutter according to claim 2, wherein the wedge surface has a circumferentially entering wedge surface.

5. A trench cutter according to claim 2, wherein the wedge surface has a circumferentially exiting wedge surface.

6. A trench cutter according to claim 2, wherein the control arm has a circumferentially entering wedge surface.

7. A trench cutter according to claim 2, wherein the control arm has a circumferentially exiting wedge surface.

8. A trench cutter according to claim 2, wherein the control ledge has a cam-like configuration for deflecting the hinged teeth.

9. A trench cutter according to claim 8, wherein the control ledge has a wavy configuration.

10. A trench cutter according to claim 2, wherein the control arm is arranged in angular manner with respect to the milling tooth.

11. A trench cutter according to claim 2, wherein the control arm is guided through an opening into the interior of hub and engages with the control ledge on the end face of hub.

12. A trench cutter according to claim 11, characterized in that one edge of the opening serves as a rear stop for the hinged teeth.

13. A trench cutter according to claim 12, characterized in that bearings of the hinged teeth and the area between the hub edge and bearing bracket, as well as the opening are protected against the penetration of soil and stones by a cover.

* * * * *